United States Patent [19]

Vlamings et al.

[11] Patent Number: 4,865,895

[45] Date of Patent: Sep. 12, 1989

[54] MARKER SLEEVE ASSEMBLY

[75] Inventors: Frank P. Vlamings, Newark; Yutaka Kawazoye; Erling Hansen, both of Los Altos; David W. Wessels, Campbell, all of Calif.

[73] Assignee: Raychem Corporation, Menlo Park, Calif.

[21] Appl. No.: 221,708

[22] Filed: Jul. 20, 1988

Related U.S. Application Data

[63] Continuation-in-part of Ser. No. 171,201, Mar. 14, 1988, abandoned, which is a continuation of Ser. No. 63,192, Jun. 17, 1987, abandoned.

[51] Int. Cl.[4] ..... B65D 85/20; B65D 63/00

[52] U.S. Cl. ..... 428/98; 428/35.1; 428/138; 206/345; 206/390; 206/820

[58] Field of Search ..... 428/98, 36, 137, 138; 206/345, 390, 820

[56] References Cited

U.S. PATENT DOCUMENTS

| | | |
|---|---|---|
| 2,013,844 | 9/1935 | Sherman . |
| 2,058,035 | 10/1936 | Rand . |
| 2,201,950 | 5/1940 | Wolters et al. . |
| 2,217,506 | 10/1940 | Bottle . |
| 3,339,828 | 9/1967 | Hiersteiner . |
| 4,032,010 | 6/1977 | Evans . |
| 4,070,223 | 1/1978 | Stalzer . |
| 4,191,405 | 3/1980 | Johnstun . |
| 4,198,451 | 4/1980 | Johnstun . |
| 4,347,274 | 8/1982 | Janssen . |
| 4,361,230 | 11/1982 | Downing et al. . |
| 4,363,401 | 12/1982 | Savagian . |
| 4,425,390 | 1/1984 | Changani et al. . |
| 4,442,939 | 4/1984 | Downing . |
| 4,448,558 | 5/1984 | Weingarten . |
| 4,487,645 | 12/1984 | Weston . |
| 4,586,610 | 5/1986 | Gandolfo . |

*Primary Examiner*—Alexander S. Thomas

*Attorney, Agent, or Firm*—Edith A. Rice; Herbert G. Burkard

[57] ABSTRACT

This invention provides a marker sleeve assembly comprising a series of flattened tubular recoverable marker sleeves held by at least one longitudinal carrier strip which holds the sleeves in fixed spaced apart relationship extending laterally from the strip. In a preferred embodiment, this invention provides a marker sleeve assembly which comprises a pair of parallel longitudinal carrier strips the inner edges of which have two layers with adhesive means on the inside facing surfaces of the two layers. The ends of the flattened tubular recoverable marker sleeves are positioned between the layers and held in position by the adhesive means on the inside surfaces of said layers of the carrier strips. The flattened marker sleeves are spaced apart whereby a portion of each adhesive means on the inside surface on each said layer of each carrier strip alternately engages the ends of the flattened marker sleeves and the opposing adhesive means on the opposing surface of the opposing layer of that carrier strip. The opposing adhesive means engaging each other aid in holding the flattened tubular marker sleeves in their flattened configuration in the assembly.

8 Claims, 3 Drawing Sheets

MARKER SLEEVE ASSEMBLY

This application is a continuation-in-part of application Ser. No. 171,201 filed Mar. 14, 1988 which in turn is a continuation of application Ser. No. 063,192 filed June 17, 1987, both of which are now abandoned the entire disclosures of which are incorporated herein by reference.

FIELD OF THE INVENTION

This invention relates to a marker sleeve assembly for holding tubular recoverable marker sleeves in appropriate position for printing indicia on the marker sleeves then providing a convenient means for dispensing the printed marker sleeves for use on wires or other objects to be identified by the printed marker sleeves.

BACKGROUND OF THE INVENTION

Heat recoverable marker sleeves have been used and dispensed in various assemblies and configurations. U.S. patent No. 4,032,010 to Evans discloses the use of heat recoverable marker sleeves on a fingered carrier suitable for printing the marker sleeves in a typewriter or computer printer. This assembly requires that the marker sleeves be partially recovered onto the fingers of the carrier to hold them on the carrier then after the marker sleeves are printed they ar removed, placed on the wire or substrate and further recovered into final position.

U.S. Pat. Nos. 4,191,405 and 4,198,451 to Johnstun disclose flattened heat shrinkable tubing as marker sleeves which are laminated onto a carrier sheet. In one case ('405) they are laminated between carrier sheets and in the other case ('451) the marker sleeves are laminated onto one carrier sheet and the leading edges of the sleeves are covered with a flap or layer of another material. Marker sleeves assembled in this fashion are difficult to register for printing and difficult to remove from the sheets for use after they are printed. These assemblies have multiple layers which increase the thickness of materials which must pass through the printer.

U.S. Pat. Nos. 4,361,230, 4,363,401, and 4,425,390 to Downing et al., Savagian and Changani et al., respectively, disclose assemblies of marker sleeves made from sheets of material which are bonded together at various seams and perforated for separation. The laminated and bonded sheets themselves form the assembly and carrier means for the marker sleeves. These types of marker sleeves suffer from the disadvantage, however, that they welded edges and perforated seams either leave rough edges protruding from the wires after the sleeve is recovered onto the wire (see FIG. 4 of '230) or, if the sleeve is recovered sufficiently to smooth out the edges, the seams frequently break and the marker sleeve fails to remain on the wire.

Therefore, it is an object of the present invention to provide a marker sleeve assembly that does not require partial or preliminary recovery of the marker sleeves onto the carrier means.

It is further an object of this invention to provide a marker sleeve assembly that is easily adaptable to being printed on platen fed or sprocket fed typewriters, computer printers and the like without having undue multiple layers of support sheets or materials.

It is a further object of this invention to provide a marker sleeve assembly for flattened tubular recoverable marker sleeves so that the tubular marker sleeves remain sufficiently flattened during printing and return to their smooth and uniform tubular shape when recovered on the wire or other substrate thereby providing smooth tubular marker sleeves without seams or rough edges.

It is yet a further object of this invention to provide a marker sleeve assembly for flattened perforated tubular recoverable marker sleeves so that the tubular marker sleeves remain sufficiently flattened during printing and return to their tubular shape when recovered on the wire or other substrate thereby providing smooth tubular marker sleeves without seams, though the ends of such sleeves will not be smooth due to the perforations thereat.

SUMMARY OF THE INVENTION

One aspect of this invention comprises a marker sleeve assembly comprising:

a series of flattened tubular recoverable marker sleeves each having first and second opposing end portions; and a first longitudinal carrier strip comprising an inner edge portion and an outer edge portion wherein the inner edge portion comprises means for securing thereto the first end portion of each flattened tubular recoverable marker sleeves such that the flattened marker sleeves are held in a fixed transverse position extending substantially perpendicularly from the carrier strip;

wherein the flattened tubular recoverable marker sleeves are space apart vertically and wherein the inner edge portion of the carrier strip engages the first end portions of the flattened marker sleeves to thereby hold the marker sleeves in their spaced apart positions.

A second longitudinal carrier strip may be provided to secure the second end portions of the marker sleeves. The inner edge of the carrier strip may comprise two layers having adhesive means on the inside opposing faces thereof to secure the end portions of the marker sleeves.

A preferred embodiment of the invention comprises a marker sleeve assembly comprising:

a pair of longitudinal spaced apart carrier strips each comprising an inner edge portion and an outer edge portion wherein the inner edge portion of each carrier strip comprises two layers having adhesive means on the inside opposing facing surfaces thereof for securing said surfaces to the outside surface of the end portions of flattened tubular recoverable marker sleeves and for securing portions of the opposing facing surfaces to each other and wherein the two said layers are adapted for receiving therebetween and in contact with the adhesive means on the facing surfaces of the two layers the end portions of flattened tubular recoverable marker sleeves;

a series of flattened tubular recoverable marker sleeves positioned transversely between said carrier strips wherein the opposing end portions of the flattened marker sleeves are positioned between the two said layers of the inner edge portions of the two carrier strips in contact with the adhesive means on the facing surfaces of the two said layers of the carrier strip whereby said adhesive means holds the flattened marker sleeves in a fixed transverse position between the pair of carrier strips; and wherein the flattened tubular recoverable marker sleeves are spaced apart vertically and wherein a portion of the adhesive means on the opposing facing surfaces of the two layers of the inner edge portion of each carrier strip alternatively engages (a) the end portions of the flattened marker sleeves to thereby hold the marker sleeves in their spaced apart positions and (b) the adhesive means on the opposing facing layer of the inner edge portion of the carrier strip in a sufficient area of contact between the spaced apart flattened marker sleeves to aid in holding the tubular marker sleeves.

In another additional aspect, this embodiment provides the above marker sleeve assembly wherein the carrier strips each comprise a strip of carrier material positioned outside the end portions of the flattened tubular marker sleeves and two opposing strips of adhesive coated tape disposed on opposite sides of the inner portion of each carrier strip whereby a portion of each tape engages the inner portion of a carrier strip and a portion of each tape alternately engages (a) the end portions of the flattened tubular marker sleeves and (b) the opposing adhesive coated surface of said the opposing tape whereby said tapes contacting each other in the spaces between the spaced apart marker sleeves to thereby aid in holding the flattened tubular marker sleeves.

In an additional aspect, this embodiment further provides the above marker sleeve assembly wherein the opposing facing adhesive means areas contact each other along and adjacent to the ends of the flattened tubular marker sleeves to thereby further aid in holding the flattened tubular marker sleeves in the desired position and configuration.

DESCRIPTION OF THE INVENTION

The marker sleeve assembly of the present invention can best be understood by reference to the drawings.

Figure 1:
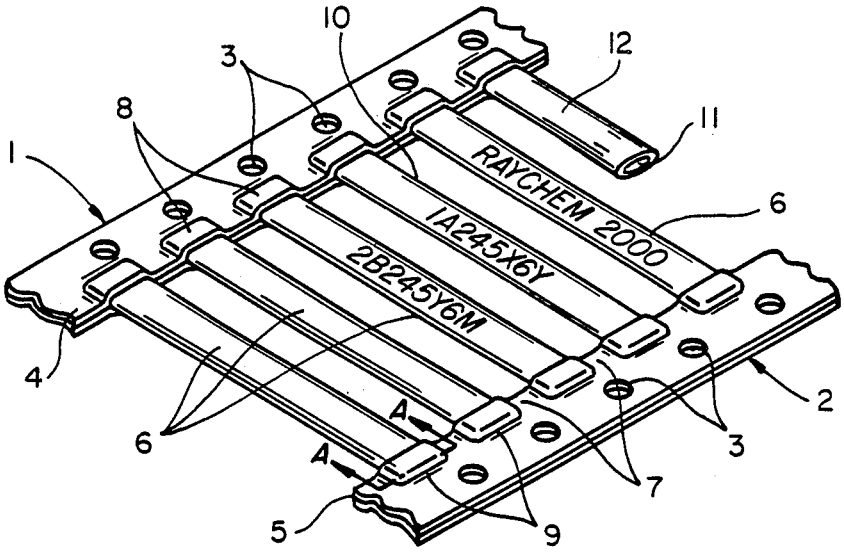
FIG. 1 shows a perspective view of a preferred embodiment of the marker sleeve assembly according to the present invention.

FIG. 1 illustrates a perspective view of a preferred embodiment of the marker sleeve assembly according to the present invention which comprises carrier strips 1, 2 having sprocket holes 3 in the outer portions of carrier strips 1, 2. The inner portions 4, 5 of carrier strips 1, 2, respectively, comprise two layers each having adhesive means on the inside opposing facing surfaces thereof. The flattened tubular marker sleeves 6 are positioned with the end portions of the marker sleeves between said opposing facing layers of the inner portions of the carrier strips and ar held in position by the adhesive means on the inside opposing facing surfaces. The adhesive means on each layer of the inner portion of each carrier strip alternately engages the opposing adhesive means on the opposite layer in regions 7 and engage the outside surface of the end portions of the marker sleeves in regions 8. In one preferred configuration the adhesive means on each layer also engages the opposing facing adhesive means along and adjacent to the ends of the marker sleeves in regions 9. The distance between the marker sleeves should be sufficient to allow sufficient area in regions 7 for the opposing adhesive means to engage each other to hold the opposing layers together. Consequently, the minimum distance between the marker sleeves will be determined by the flexibility of the carrier strip, the effectiveness and bonding power of the adhesive means to engage and hold the opposing adhesive means, the degrees of bonding desired in regions 7 and other factors that will be apparent to one skilled in the art. Otherwise, the distance between marker sleeves can be increased and adjusted as desired for printing alignment purposes, packaging purposes and the like. Regions 7 where the opposing adhesive means engage each other can be of any length provided that the minimum length and surface area is provided to meet the requirements stated above. In one preferred embodiment it is desired that the top or leading edge 10 of each flattened tubular marker sleeve be aligned with a pair of sprocket holes 3 in the two carrier sleeves to aid in programming computer printers for proper alignment of printing indicia on the marker sleeves.

It should be noted that flattened tubular marker sleeves tend not to remain in the flattened condition but tend to return to their tubular configuration as illustrated at cross-section 11 of marker sleeve 12. Tubular marker sleeves can be flattened with sufficient head and pressure so that they do tend to remain in the flattened configuration. During this process a distinctive crease or edge portion may be imparted to a tubular marker sleeve. Such a crease tends to help maintain flatness of the tubing. One of the advantages of the marker sleeve assembly of this embodiment of the invention is that the opposing layers in the inner portions of each carrier strip which are engaged the opposing layer in region 7 assist in holding the flattened tubular marker sleeves in their flattened condition until they can be printed and removed from the marker sleeve assembly of this invention.

Figure 2:
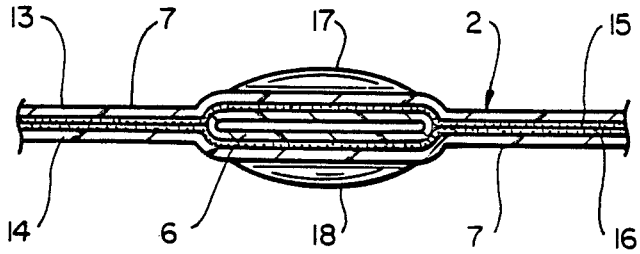
FIG. 2 shows a cross-section detail of the end portion of a marker sleeve at section A—A of FIG. 1.

FIG. 2 is a section view A—A in FIG. 1 showing the end view of a flattened tubular marker sleeve 6 the end portion of which is held between opposing layers 13, 14 of carrier strip 2 and is secured in position by adhesive layers 15, 16 on opposing surfaces of layers 13, 14. FIG. 2 also illustrates that in the region between the two carrier strips 1, 2 marker sleeve 6 may not remain completely in its flattened condition and may assume an oval or elliptical shape as indicated by surfaces 17, 18 in FIG. 2. However, it is to be noted that the sleeves preferably maintain their flattened configuration. It should also be noted that the adhesive surfaces 15, 16 are bonded together in region 7.

Figure 3:
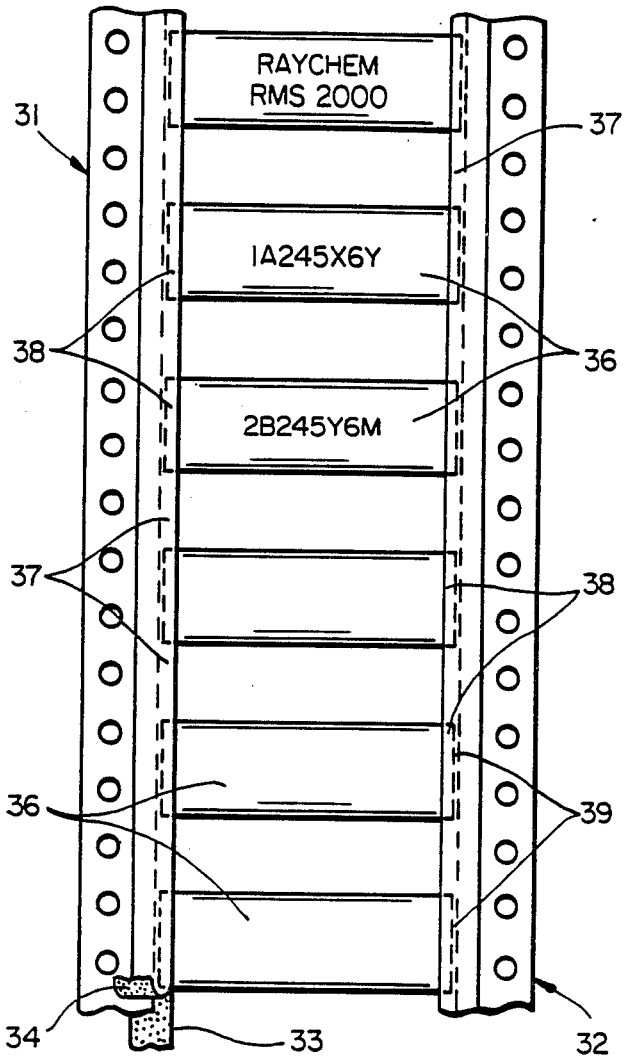
FIG. 3 shows a top view of another embodiment of the marker sleeve assembly according to the present invention.

FIG. 3 illustrates another embodiment of the marker sleeve assembly of the present invention wherein carrier strips 31, 32 ar separate strips and the adhesive means is provided by opposing tapes 33, 34 having adhesive surfaces to engage carrier strip 31 and the end portions of marker sleeves 36. Opposing adhesive tapes 33, 34 bond to each other in regions 37 and bond to the opposite sides of the end portions of flattened tubular marker sleeves in regions 39. Tapes 33, 34 engage the carrier strip 31 along the inner portion of carrier strip 31 and along its entire length. Adhesive strips 33, 34 can be segmented or perforated or discontinuous which in some cases will aid in the ease of removal of the marker sleeves from the marker sleeve assembly provided that sufficient bonding in regions 37, 39 are achieved by the lengths of tapes 33, 34 which are used.

In normal configuration the inner edge of carrier strips 31, 32 are adjacent to the ends of the flattened tubular marker sleeves and the adhesive tapes 33, 34 cover the area of each as explained above. However, in some configurations it may be desirable to leave a space in region 38 between the inner edge of carrier strip 31 and the end of marker sleeve 36 to allow the opposing adhesive surfaces of opposing tapes 33, 34 to bond to each other along and adjacent to the ends of marker sleeves 36 to further aid in holding the flattened tubular marker sleeves 36 in the desired position and aid in holding the flattened marker sleeves in the desired flattened configuration.

Figure 4:
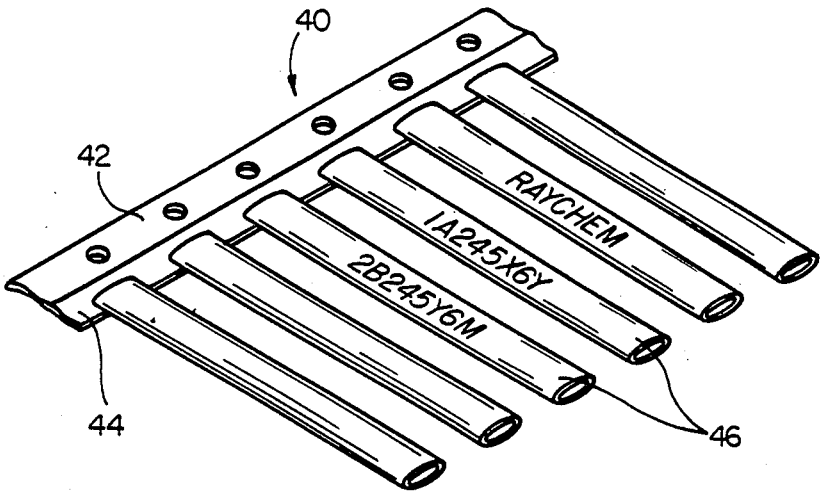
FIG. 4 shows a perspective view of a further embodiment of the marker sleeve assembly according to the present invention.

FIG. 4 illustrates a perspective view of a further embodiment of the invention. In FIG. 4, a single carrier strip 40 comprises inner edge portion 42 and outer edge portion 44. Flattened tubular recoverable sleeves 46 are secured to the inner edge portion 44 of carrier strip 40 by means of an adhesive on the surface of the inner edge surface. The second end portion of the flattened sleeves in this embodiment are free. If desired, a second carrier strip (not shown) similar to the first can be positioned to secure the second end portions of the marker sleeves. The securing means on the inner edge portion of one or both of the carrier strips may comprise two layers with adhesive on the facing surfaces as described above with reference to FIGS. 1 and 3.

In another embodiment of the invention, a single carrier strip may be provided with a center portion and two outer edge portions, each of which is provided with means to secure the first end portions marker sleeves thereto, as described above. The center portion may be provided with sprocket holes, if desired. The means for securing the sleeves may be adhesive means along the outer edge portions or preferably, as described above, the edge portions may comprise two layers with adhesive means on the inside opposing facing surfaces thereof. Additional carrier strips may be provided to secure the second end portions of the marker sleeves, if desired.

The above embodiments are illustrations of the marker sleeve assembly of the present invention. Other embodiments will be apparent to one skilled in the art. The selection of materials for carrying out embodiments of the present invention will likewise be apparent to one skilled in the art depending on the size and configuration of the marker sleeve assembly of this invention.

We claim:

1. A marker sleeve assembly comprising:

a pair of longitudinal spaced apart carrier strips each comprising an inner edge portion and an outer edge portion wherein the inner edge portion of each carrier strip comprises two layers having adhesive means on the inside opposing facing surfaces thereof for securing said surfaces to the outside surface of the end portions of flattened tubular recoverable marker sleeves and for securing portions of the opposing facing surfaces to each other and wherein the two said layers are adapted for receiving therebetween and in contact with the adhesive means on the facing surfaces of the two layers the end portions of flattened tubular recoverable marker sleeves;

a series of flattened tubular recoverable marker sleeves positioned transversely between said carrier strips wherein the opposing end portions of the flattened marker sleeves are positioned between the two said layers of the inner edge portions of the two carrier strips in contact with the adhesive means on the facing surfaces of the two said layers of the carrier strip whereby said adhesive means holds the flattened marker sleeves in a fixed transverse position between the pair of carrier strips; and wherein the flattened tubular recoverable marker sleeves are spaced apart vertically and wherein a portion of the adhesive means on the opposing facing surfaces of the two layers of the inner edge portion of each carrier strip alternately engages (a) the end portions of the flattened marker sleeves to thereby hold the marker sleeves in their spaced apart positions and (b) the adhesive means on the opposing facing layer of the inner edge portion of the carrier strip in a sufficient area of contact between the spaced apart flattened marker sleeves to aid in holding the tubular marker sleeves.

2. A marker sleeve assembly according to claim 1 wherein the carrier strips each comprise a strip of carrier material positioned outside the end portions of the flattened tubular marker sleeves and two opposing strips of adhesive coated tape disposed on opposite sides of the inner portion of each carrier strip whereby a portion of each tape engages the inner portion of a carrier strip and a portion of each tape alternately engages (a) the end portions of the flattened tubular marker sleeves and (b) the opposing adhesive coated surface of said the opposing tape whereby said tapes contacting each other in the spaces between the spaced apart marker sleeves to thereby aid in holding the flattened tubular marker sleeves.

3. A marker sleeve assembly according to claim 2 wherein the opposing facing adhesive surfaces of the opposing tapes contact each other along and adjacent to the ends of the flattened tubular marker sleeves to thereby further aid in holding the flattened tubular marker sleeves in the desired position and configuration.

4. A marker sleeve assembly according to claim 1 wherein the opposing facing adhesive means areas contact each other along and adjacent to the ends of the flattened tubular marker sleeves to thereby further aid in holding the flattened tubular marker sleeves in the desired position and configuration.

5. A marker sleeve assembly comprising:

a series of flattened tubular recoverable marker sleeves each having first and second opposing end portions; and a first longitudinal carrier strip comprising an inner edge portion and an outer edge portion wherein the inner edge portion comprises means for securing thereto the first end portion of each flattened tubular recoverable marker sleeves such that the flattened marker sleeves are held in a fixed transverse position extending laterally from the carrier strip;

wherein the flattened tubular recoverable marker sleeves are space apart vertically and wherein the inner edge portion of the carrier strip engages the first end portions of the flattened marker sleeves to thereby hold the marker sleeves in their spaced apart positions.

6. A marker sleeve assembly according to claim 5, which further comprises a second longitudinal carrier strip comprising an inner edge portion and an outer edge portion wherein the inner edge portion of said carrier strip comprises means for securing thereto the second end portions of said flattened tubular recoverable marker sleeves, wherein the second carrier strip is positioned so as to hold the second end portions of the flattened marker sleeves to hold the marker sleeves in their spaced apart positions.

7. A marker sleeve assembly according to claim 5 or claim 6 wherein each said securing means comprises adhesive means.

8. A marker sleeve assembly according to claim 5 or claim 6 wherein at least one of said carrier strips comprises two layers having adhesive means on the inside opposing faces thereof wherein the two layers are adapted for receiving therebetween and in contact with the adhesive means on the facing surfaces of the two layers an end portion of the flattened tubular recoverable marker sleeves.

* * * * *